United States Patent [19]

Lee

[11] Patent Number: 4,612,909

[45] Date of Patent: Sep. 23, 1986

[54] ROOM EXHAUST DUCT

[76] Inventor: Chi-Min Lee, #201-24 Yeokkok-Dong Buchunshi, Kyeongki-Do, Rep. of Korea

[21] Appl. No.: 704,571

[22] Filed: Feb. 22, 1985

[51] Int. Cl.[4] ..... F24C 15/20

[52] U.S. Cl. ..... 126/299 D; 98/115.4

[58] Field of Search ..... 98/115.1, 115.4; 126/299 R, 299 D

[56] References Cited

U.S. PATENT DOCUMENTS 2,939,378 6/1960 Zalkind ..... 98/115.4

4,292,061 9/1981 Land ..... 55/507 X

FOREIGN PATENT DOCUMENTS 1339874 12/1973 United Kingdom ..... 98/115.4

*Primary Examiner*—Harold Joyce

*Attorney, Agent, or Firm*—Walter F. Wessendorf, Jr.

[57] ABSTRACT

Disclosed is a room exhaust duct for collecting and exhausting grease, smoke, heat, steam and odors emanating from cooking food at a cooking table. The room exhaust duct has a hood, flexible duct and adapter duct assembly connected and in communication with the adapted duct assembly connected to and in communication with a permanent ceiling exhaust duct. A reversible hoisting motor is switch-operated and is mounted on the adapter duct assembly. The motor drives a drum reel to wind up or lower a cable connected to the hood to position same in various positions including the fully retracted position of the hood providing unobstructed and esthetically pleasing room space and the fully lowered position of the hood to maximize the collecting and exhausting of such grease, smoke, heat, steam and odors.

1 Claim, 4 Drawing Figures

ROOM EXHAUST DUCT

BACKGROUND OF THE INVENTION

1. Technical Field

This invention relates to a room exhaust duct for collecting and exhausting therefrom grease, smoke, heat, steam and odors from cooking.

2. Background

Cooking of steak, Bulkogi, Yakiniku, fish, etc. at a cooking table results in unwanted grease, smoke, heat, steam and odors which would otherwise contaminate the room, its furniture, one's person and his clothing unless effectively removed and exhausted from the area of such cooking table.

The problem in the art to which this invention apertains is the need for an adjustably positionable and retractable room exhaust duct for use in adjustably positioning same relative to a cooking table to maximize the collecting and exhausting therefrom of grease, smoke, heat, steam and odors emanating from such cooking; and which exhaust duct, after completion of its use, can be retracted to its position when not in use to afford unobstructed room space relative to such cooking table and thereby to clear such room that is also esthetically pleasing to the eye.

Accordingly, the object of this invention is to provide a room exhaust duct which will contribute to the solution of the discussed problems of the art.

SUMMARY OF THE INVENTION

In accordance with the invention, there is provided a room exhaust duct that can be adjustably disposed and positioned with respect to a cooking table to maximize the quantity of grease, smoke, heat, steam and odors which may be effectively exhausted while cooking food. The room exhaust duct has a hood in communication with and carried by an accordion-like, flexible duct in communication with and carried by an adapter duct in communication with and fixed to a permanent ceiling exhaust duct. A reversible motor, operatively connected with such hood via a cable, allows the hood to be lowered by force of gravity to various positions including its lowermost position to maximize exhaustion and to be retracted to its uppermost position when not in use. Such retracted position affords unobstructed room space relative to the cooking table while at the same time presenting a neat and uncluttered appearance that is esthetically pleasing to the eye.

BRIEF DESCRIPTION OF THE DRAWINGS

This object and other objects of the invention should be discerned and appreciated from the detailed description taken in conjunction with the drawings, wherein like reference numerals refer to similar parts and elements throughout the several views, in which.

DESCRIPTION OF THE PREFERRED EMBODIMENT

Figure 1:
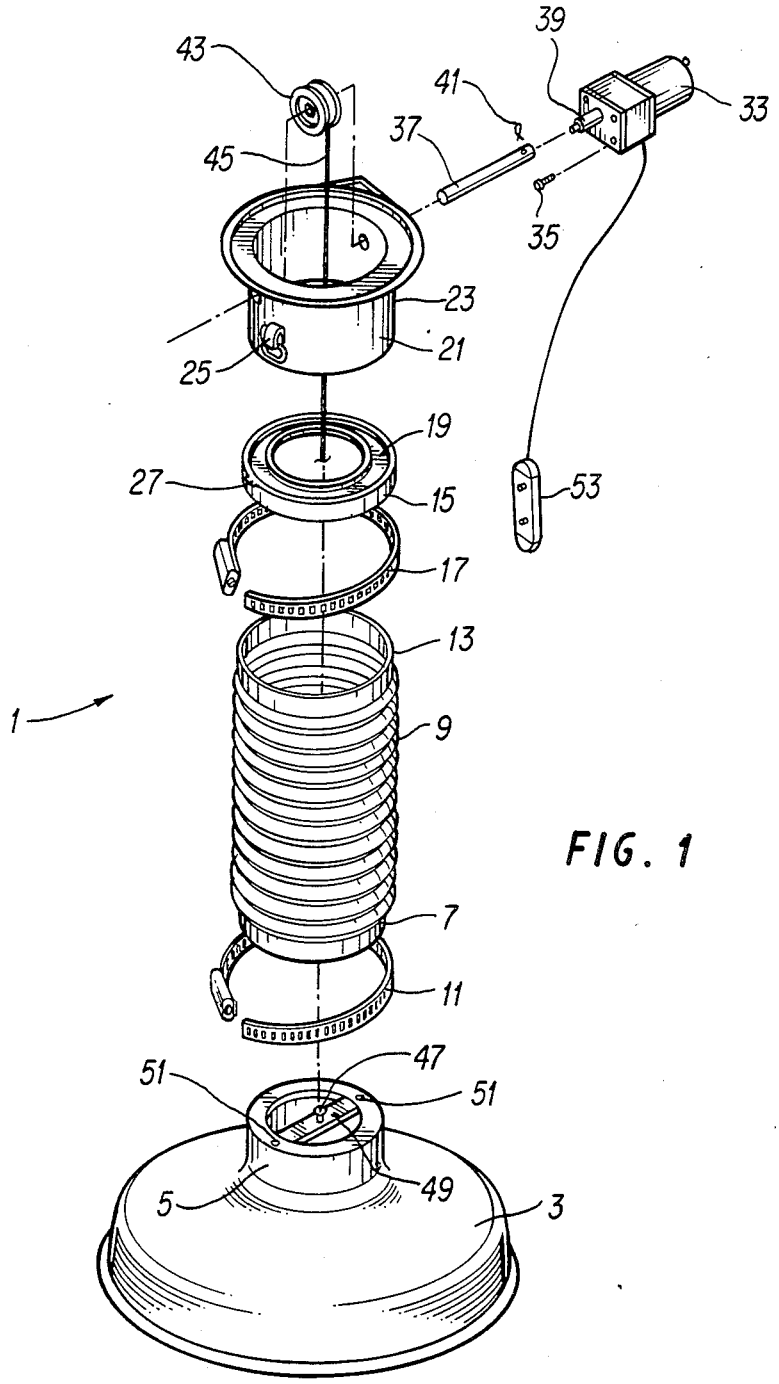
FIG. 1 is an exploded perspective view of the invention.
Figure 2:
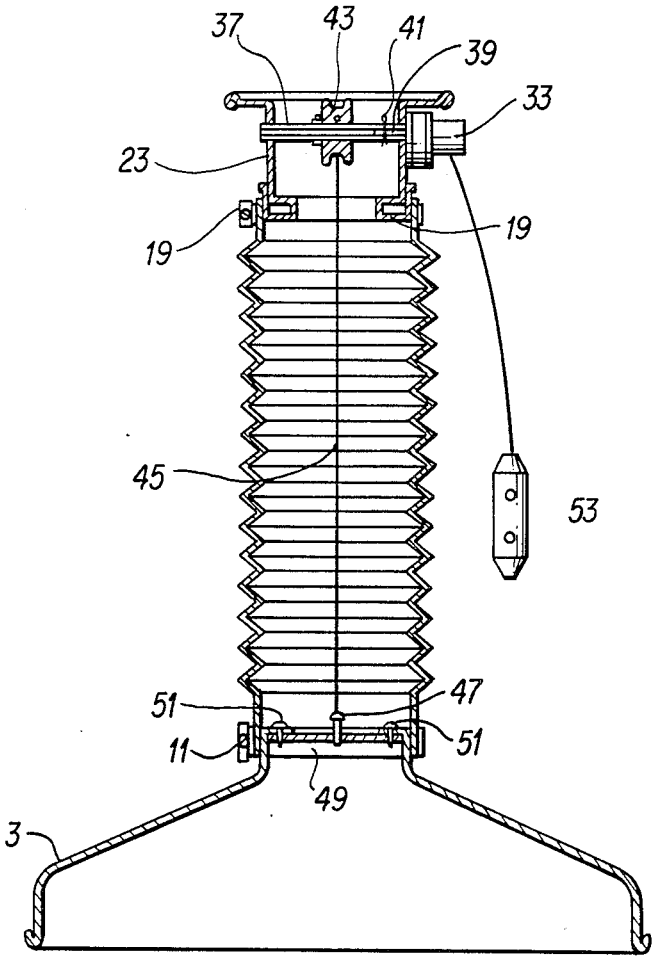
FIG. 2 is a view of the invention in section.
Figure 3:
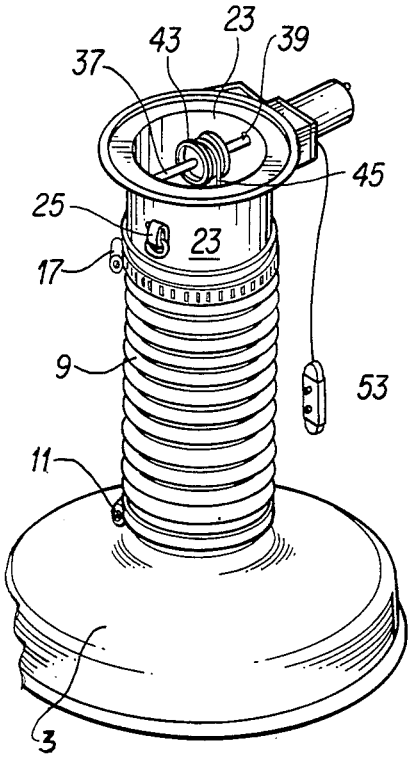
FIG. 3 is a perspective view of the invention.

To facilitate understanding of the invention, a nomenclature list is herewith provided:

1 generally refers to the invention

3 hood
5 neck portion of hood 3
7 lower end of flexible duct 9
9 accordion-like, flexible duct
11 worm-gear clamp
13 upper end of duct 9
15 sleeve
17 worm-gear clamp
19 annular shoulder portion of sleeve 15
21 lower distal portion of adapter duct 23
23 adapter duct
25 hinged ring clamp on adapter duct 23
27 outturned ear on sleeve 15
29 ceiling
31 exhaust duct
33 reversible hoisting motor
35 cap screw
37 coupled shaft
39 drive shaft of motor 33
41 lock pin
43 take-up drum reel
45 cable
47 cable fastener
49 mounting bracket
51 cap screw
53 switch
55 cooking table
57 indication of lowermost position of hood 3
59 indication of retracted position of hood 3

In FIG. 1 of the drawings, reference numeral 1 generally refers to the invention of the room exhaust duct.

Room exhaust duct 1 comprises a hood 3 having a neck portion 5. The lower end 7 of an accordion-like, flexible duct 9 complementally receives neck portion 5 with fixed relationship therewith effected by means of a worm-gear clamp 11 appropriately engaged therewith and tightened thereon. The upper end 13 of duct 9 complementally receives a sleeve 15 with fixed relationship therewith effected by means of a worm-gear clamp 17 appropriately engaged therewith and tightened thereon. Sleeve 15 has an annular shoulder portion 19 which complementally receives the lower distal portion 21 of an adapter duct 23. Sleeve 15 is detachably mounted in fixed relationship with adapter duct 23 by means of a hinged ring clamp 25 carried by adapter duct 23. Ring clamp 25 is releasably engaged in locking relationship with an outturned ear integrally formed with sleeve 15. Adapter duct 23 is in flush mounting relationship with ceiling 29 and is appropriately fixed to an exhaust duct 31, shown in phantom lines, to exhaust such grease, smoke, heat, steam and odors exteriorly of the room. Adapter duct 23 fixedly mounts a reversible hoisting motor 33 by means of cap screws 35. Adapter duct 23 freely mounts in appropriate bearing relationship a coupled shaft 37 connected in rectilinear relationship to drive shaft 39 of motor 33 by means of a transversely disposed and engaged lock pin 41. Fixedly carried on coupled shaft 37 is a take-up drum reel 43 upon which is wound cable 45 which is disposed interiorly of adapter duct 23, sleeve 15 and flexible duct 9. One end of cable 45 is appropriately fixed to drum reel 43 and its other end is fixed to a cable fastener 47 fixedly carried by a mounting bracket 49 fixed to the neck portion 5 of hood 3 by means of cap screws 51. Appropriate actuation to switch electrically connected to motor 33 will close a circuit to motor 33 to drive shaft 39 in one direction with the take-up drum reel 43 winding up cable 45 to raise hood 3, and such switch 53 can be actuated alternatively to close a circuit to motor 33 in order to drive shaft 39 in the opposite direction with the drum reel 43 unwinding cable 45 with hood 3 concomitantly being lowered by force of gravity.

Figure 4:
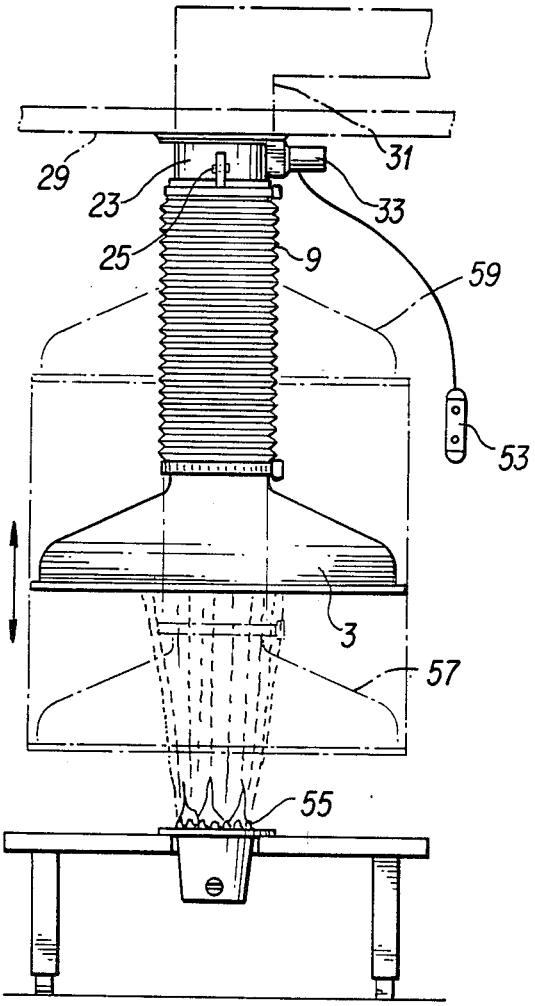
FIG. 4 is an elevational view of the invention.

In the operational use of the room exhaust duct 1, same is appropriately disposed and positioned in appropriate relationship with respect to a cooking table 55 so that grease, smoke, heat, steam and odors emanating from the cooking of food on cooking table 55 can be collected and exhausted through hood 3, flexible duct 9 and exhaust duct 31 exteriorly of the room. Then switch 53 is appropriately actuated to raise or lower hood 3. Two positions, as indicated by reference numerals 57 and 59 in FIG. 4, are shown in phantom lines. Position 57 represents hood 3 in its lowermost position to maximize the exhaustion of grease, smoke, heat, steam and odors from food being cooked on cooking table 55. Position 59 represents hood 3 in its uppermost fully retracted position when not in use. It should be discerned and appreciated that retracted position 59 not only affords unobstructed room space relative to the cooking table 55, but also is esthetically pleasing to the eye by presenting a neat and uncluttered appearance.

Having thusly described my invention, I claim:

1. A room exhaust duct having a duct for use with a fixed and permanent ceiling exhaust duct in collecting and exhausting grease, smoke, heat, steam and odors from a cooking table, said hood of said room exhaust duct having a lowermost position to maximize such exhaustion and said hood of said room exhaust duct having an uppermost retracted position when not in use for affording unobstructed room space relative to said cooking table; said room exhaust duct comprising said hood and comprising an accordion-like flexible duct, adapter duct, sleeve, hinged ring clamp, reversible hoisting motor, take-up drum reel, coupled shaft, cable and switch; said flexible duct being in interposed, connected and communicative relationship between and with said hood and sleeve, said hood having a neck portion, said accordion-like flexible duct receiving said neck portion, said sleeve receiving said adapter duct in detachable mounting relationship, said adapter duct carrying said hinged ring clamp, said sleeve having an outturned ear integrally formed therewith, said ring clamp being releasably engaged in locking relationship with said outturned ear to effect such detachable mounting relationship of said sleeve and said adapter duct, said adapter duct fixedly mounting said motor, said adapter duct freely mounting said coupled shaft in bearing relationship, said coupled shaft fixedly carrying said drum reel, said coupled shaft and drum reel being disposed interiorly of said adapter duct, said motor having a drive shaft, said coupled shaft being connected to said drive shaft, said cable having ends connected to said drum reel and hood, said switch being electrically connected to said motor to close a circuit upon actuation of said switch to drive said shaft and drum reel in one direction to wind said cable on said drum reel and thereby raise said flexible duct and hood to such uppermost retracted position, and said switch being electrically connected to said motor to close another circuit upon alternate actuation of said switch to drive said shaft and drum reel in an opposite direction to allow said cable, wound on said drum reel, to unwind and thereby lower said flexible duct and hood by force of gravity to such lowermost position.

* * * * *